US011078752B2

(12) United States Patent
Costa De Oliveira et al.

(10) Patent No.: US 11,078,752 B2
(45) Date of Patent: Aug. 3, 2021

(54) SMART CEMENTING WIPER PLUG

(71) Applicant: Saudi Arabian Oil Company, Dhahran (SA)

(72) Inventors: Victor Carlos Costa De Oliveira, Dhahran (SA); Ramon Rodriguez Rico, Dhahran (SA); Mario Augusto Rivas Martinez, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/716,374

(22) Filed: Dec. 16, 2019

(65) Prior Publication Data

US 2021/0180428 A1 Jun. 17, 2021

(51) Int. Cl.

| | |
|---|---|
| ***E21B 33/16*** | (2006.01) |
| ***E21B 47/024*** | (2006.01) |
| ***E21B 47/12*** | (2012.01) |

(52) U.S. Cl.

CPC ..... *E21B 33/16* (2013.01); *E21B 47/12* (2013.01); *E21B 47/024* (2013.01)

(58) Field of Classification Search

CPC ..... E21B 47/024; E21B 47/09; E21B 33/13; E21B 33/16; E21B 33/165; E21B 33/167

See application file for complete search history.

(56) References Cited

U.S. PATENT DOCUMENTS

| | | | | |
|---|---|---|---|---|
| 5,105,894 | A | 4/1992 | Enderlin | |
| 6,634,425 | B2 * | 10/2003 | King | E21B 33/16 166/253.1 |
| 7,363,967 | B2 | 4/2008 | Burris et al. | |
| 8,567,488 | B2 | 10/2013 | Gambier et al. | |
| 8,973,656 | B2 | 3/2015 | McClung, III | |
| 9,169,705 | B2 * | 10/2015 | Helms | E21B 33/127 |
| 9,222,349 | B2 | 12/2015 | Leblanc | |
| 9,347,309 | B2 | 5/2016 | Raducanu et al. | |
| 9,366,134 | B2 * | 6/2016 | Walton | E21B 43/14 |

(Continued)

FOREIGN PATENT DOCUMENTS

| | | | |
|---|---|---|---|
| WO | 2015047262 | A1 | 4/2015 |
| WO | 2017147329 | A1 | 8/2017 |
| WO | 2018178607 | A1 | 10/2018 |

OTHER PUBLICATIONS

International Search Report and Written Opinion of PCT Application No. PCT/US2020/065219 dated Mar. 12, 2021: pp. 1-11.

*Primary Examiner* — Shane Bomar

(74) *Attorney, Agent, or Firm* — Bracewell LLP; Constance G. Rhebergen; Linda L. Morgan

(57) ABSTRACT

A method and system for completing cementing operations in a subterranean well with a wiper plug assembly includes delivering the wiper plug assembly into a casing, the wiper plug assembly having a wiper plug body with a circular cross section and a resilient wiper element that engages an inner diameter of the casing string. An inclination of the wiper plug assembly is measured in three dimensions with an accelerometer assembly and an azimuth of the wiper plug assembly is measured in three dimensions with a magnetometer. The inclination and the azimuth of the wiper plug assembly are delivered to a control unit in real time. An inclination of the wiper plug assembly is determined in real time. The inclination of the wiper plug assembly is delivered to an earth's surface in real time with a transmitter of the electronics package.

13 Claims, 3 Drawing Sheets

(56) References Cited

U.S. PATENT DOCUMENTS

| | | | | |
|---|---|---|---|---|
| 9,404,358 | B2 | 8/2016 | Steele | |
| 9,896,926 | B2 | 2/2018 | Steele | |
| 2005/0241825 | A1* | 11/2005 | Burris, II | E21B 23/00 166/255.1 |
| 2010/0175891 | A1 | 7/2010 | Rondeau et al. | |
| 2017/0335678 | A1 | 11/2017 | Ciezobka et al. | |
| 2018/0016891 | A1 | 1/2018 | Rogozinski et al. | |
| 2018/0094685 | A1* | 4/2018 | Marya | C22C 38/02 |
| 2018/0245424 | A1 | 8/2018 | Stokley et al. | |

* cited by examiner

SMART CEMENTING WIPER PLUG

BACKGROUND OF THE DISCLOSURE

1. Field of the Disclosure

The present disclosure relates to subterranean well development, and more specifically, the disclosure relates to cementing operations within the subterranean well during well development operations.

2. Description of the Related Art

When completing a subterranean well, casing can be inserted into the wellbore and secured in place with cement. The cement can be injected downhole through the casing, forced out of the casing at a downhole end of the casing, and travel into an annulus between the casing and wellbore wall. A wiper plug can be used for pushing the cement out of the downhole end of the casing, for wiping any remaining cement from the casing string, and for closing the valve located at the landing collar.

A displacement fluid, such as water, or an appropriately weighted mud can be pumped into the casing string uphole of the wiper plug. The pressurized fluid can provide a motive force to urge the wiper plug downward through the casing string to extrude the cement from the downhole end of the casing string and back up into the annulus.

SUMMARY OF THE DISCLOSURE

Embodiments of the disclosure provide confirmation of the operation of the wiper plug within the casing string, reducing the risk of requiring any remedial cement operations due to misinterpretation of the displacement of the cement within the casing string and the annulus around the casing string. Systems and methods are provided for tracking the progress of a wiper plug in real time as the wiper plug travels through the casing string within the wellbore.

In an embodiment of this disclosure, a method for completing cementing operations in a subterranean well with a wiper plug assembly includes delivering the wiper plug assembly into a casing string that extends into the subterranean well. The wiper plug assembly has a wiper plug body with a circular cross section and a resilient wiper element that engages an inner diameter of the casing string. An inclination of the wiper plug assembly is measured in three dimensions with an accelerometer assembly of an electronics package of the wiper plug assembly that is located within the wiper plug body. An azimuth of the wiper plug assembly is measured in three dimensions with a magnetometer of the electronics package. The inclination and the azimuth of the wiper plug assembly is delivered to a control unit of the electronics package in real time. The inclination of the wiper plug assembly is delivered to an earth's surface in real time with a transmitter of the electronics package.

In alternate embodiments, the inclination of the wiper plug assembly can be used to determine a location of the wiper plug assembly within the subterranean well with a computational device at the earth's surface. Determining the location of the wiper plug assembly within the subterranean well can further include comparing the inclination of the wiper plug assembly to a known survey of the subterranean well. A travel of the wiper plug assembly through the subterranean well can be tracked in real time at the earth's surface on the computational device.

In other alternate embodiments, the inclination of the wiper plug assembly can be used to confirm that the wiper plug assembly has exited a cement head with a computational device at the earth's surface. The inclination of the wiper plug assembly can alternately be used to confirm that the wiper plug assembly has landed on a landing collar within the subterranean well with a computational device at the earth's surface. The wiper plug assembly can include a timer and the method can further include using the timer to determine a start of the measuring of the inclination of the wiper plug assembly and a start of the measuring of the azimuth of the wiper plug assembly.

In an alternate embodiment of this disclosure, a method for completing cementing operations in a subterranean well with a wiper plug assembly includes loading the wiper plug assembly into a cement head in communication with a bore of a casing string that extends into the subterranean well. The wiper plug assembly is launched into the casing string from the cement head. An inclination of the wiper plug assembly is measured in three dimensions with an accelerometer assembly of an electronics package of the wiper plug assembly. An azimuth of the wiper plug assembly is measured in three dimensions with a magnetometer of the electronics package. The inclination and the azimuth of the wiper plug assembly are delivered to a control unit of the electronics package in real time. The inclination and the azimuth of the wiper plug assembly is delivered to a computational device at an earth's surface in real time with a transmitter of the electronics package. A location of the wiper plug assembly within the subterranean well is determined with the computational device at the earth's surface in real time from the inclination and the azimuth of the wiper plug assembly.

In alternate embodiments, determining the location of the wiper plug assembly within the subterranean well can further include comparing the inclination of the wiper plug assembly to a known survey of the subterranean well. A travel of the wiper plug assembly can be tracked through the subterranean well in real time at the earth's surface on the computational device.

In other alternate embodiments, the inclination of the wiper plug assembly can be used to confirm that the wiper plug assembly has exited the cement head with the computational device at the earth's surface in real time. Alternately, the inclination of the wiper plug assembly can be used to confirm that the wiper plug assembly has landed on a landing collar within the subterranean well with the computational device at the earth's surface in real time. The wiper plug assembly can include a timer and the method can further include using the timer to determine a start of the measuring of the inclination of the wiper plug assembly and a start of the measuring of the azimuth of the wiper plug assembly.

In a further alternate embodiment of this disclosure, a wiper plug assembly for cementing operations in a subterranean well includes a wiper plug body, the wiper plug body having a circular cross section and a resilient wiper element sized to engage an inner diameter of a casing string. An electronics package is located within the wiper plug body. The electronics package includes an accelerometer assembly operable to measure an inclination of the wiper plug body in three dimensions. The electronics package also includes a magnetometer operable to measure an azimuth of the wiper plug assembly in three dimensions and a control unit operable to receive and process the inclination and the azimuth of the wiper plug assembly in real time. The electronics package further includes a transmitter operable to deliver the inclination of the wiper plug assembly to an earth's surface in real time.

In alternate embodiments, a computational device at the earth's surface can be operable to use the inclination of the wiper plug assembly to determine a location of the wiper plug assembly within the subterranean well. The wiper plug assembly can include a timer operable to determine a start of the measuring of the inclination of the wiper plug assembly and a start of the measuring of the azimuth of the wiper plug assembly. A battery can be in communication with the control unit and operable to provide power to the control unit.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

As used in this Specification, the term "substantially equal" means that the values being referenced have a difference of no more than two percent of the larger of the values being referenced.

Where reference is made in the specification and appended Claims to a method comprising two or more defined steps, the defined steps can be carried out in any order or simultaneously except where the context excludes that possibility.

Figure 1:
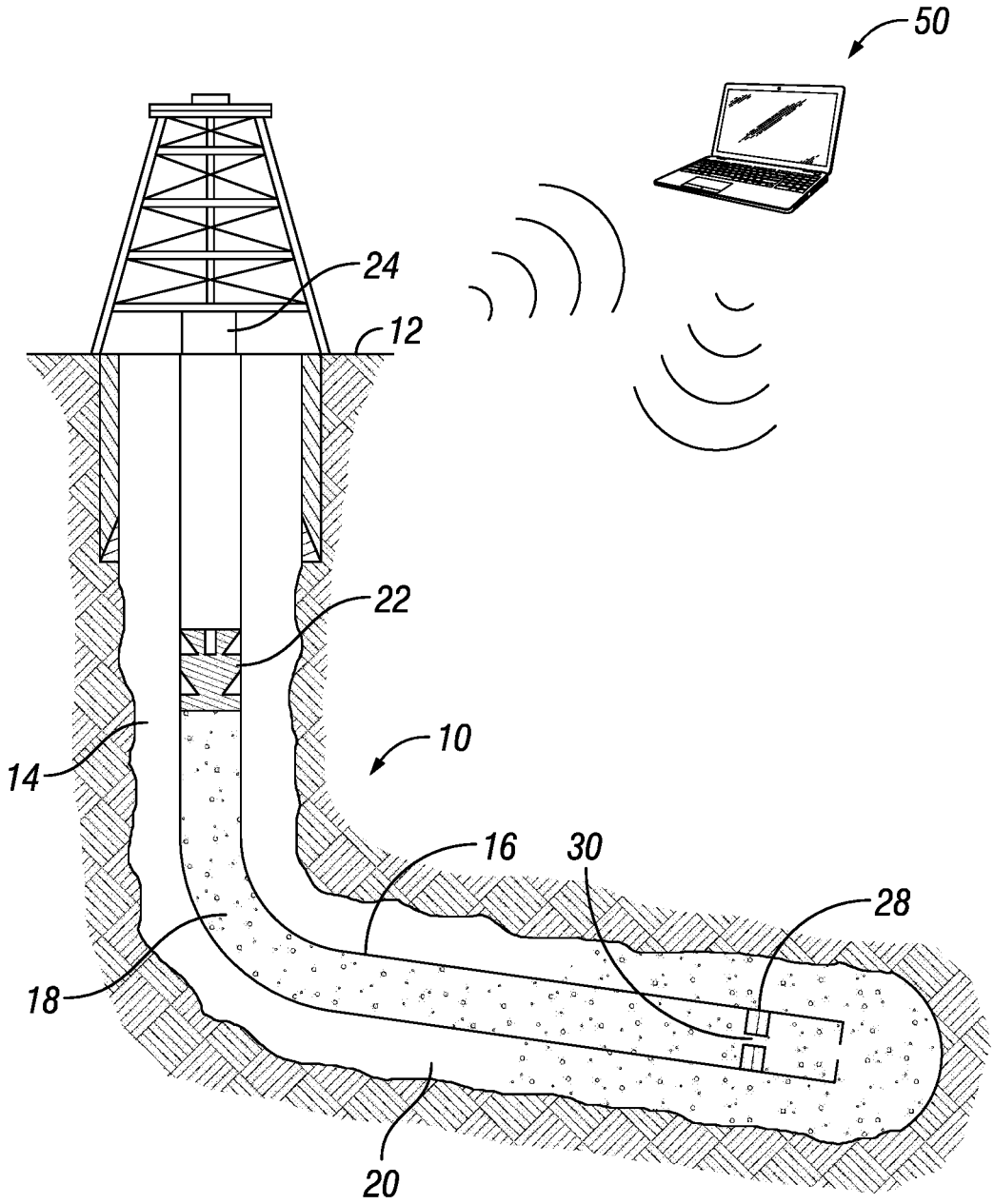
FIG. 1 is a partial section view of a subterranean well with a smart cementing wiper plug, in accordance with an embodiment of this disclosure, shown with the smart cementing wiper plug within a casing string.

Looking at FIG. 1, subterranean well 10 extends downwards from a surface of the earth 12, which can be a ground level surface or a subsea surface. Wellbore 14 of subterranean well 10 can extended generally vertically relative to the surface. Wellbore 14 can alternately include portions that extend generally horizontally or in other directions that deviate from generally vertically from the surface. Subterranean well 10 can be a well associated with hydrocarbon development operations, such as a hydrocarbon production well, an injection well, or a water well.

Casing string 16 extends into wellbore 14 of subterranean well 10. In order to secure casing string 16 within wellbore 14, cement 18 can be injected though the central bore of casing string 16. Cement 18 can exit a downhole end of casing string 16 and move in an uphole direction within annulus 20. Annulus 20 is defined between an outer diameter surface of casing string 16 and an inner diameter surface of wellbore 14. Sufficient cement 18 is injected into subterranean well 10 to fill annulus 20 (FIG. 2).

Wiper plug assembly 22 can be delivered into the bore of casing string 16 to help push cement 18 out of the downhole end of casing string 16. Wiper plug assembly 22 can also wipe any remaining cement 18 from the bore of casing string 16 as wiper plug assembly 22 moves downhole within casing string 4. Wiper plug assembly 22 can be delivered into the bore of casing string 16 by being launched into casing string 16 from cement head 24.

Figure 2:
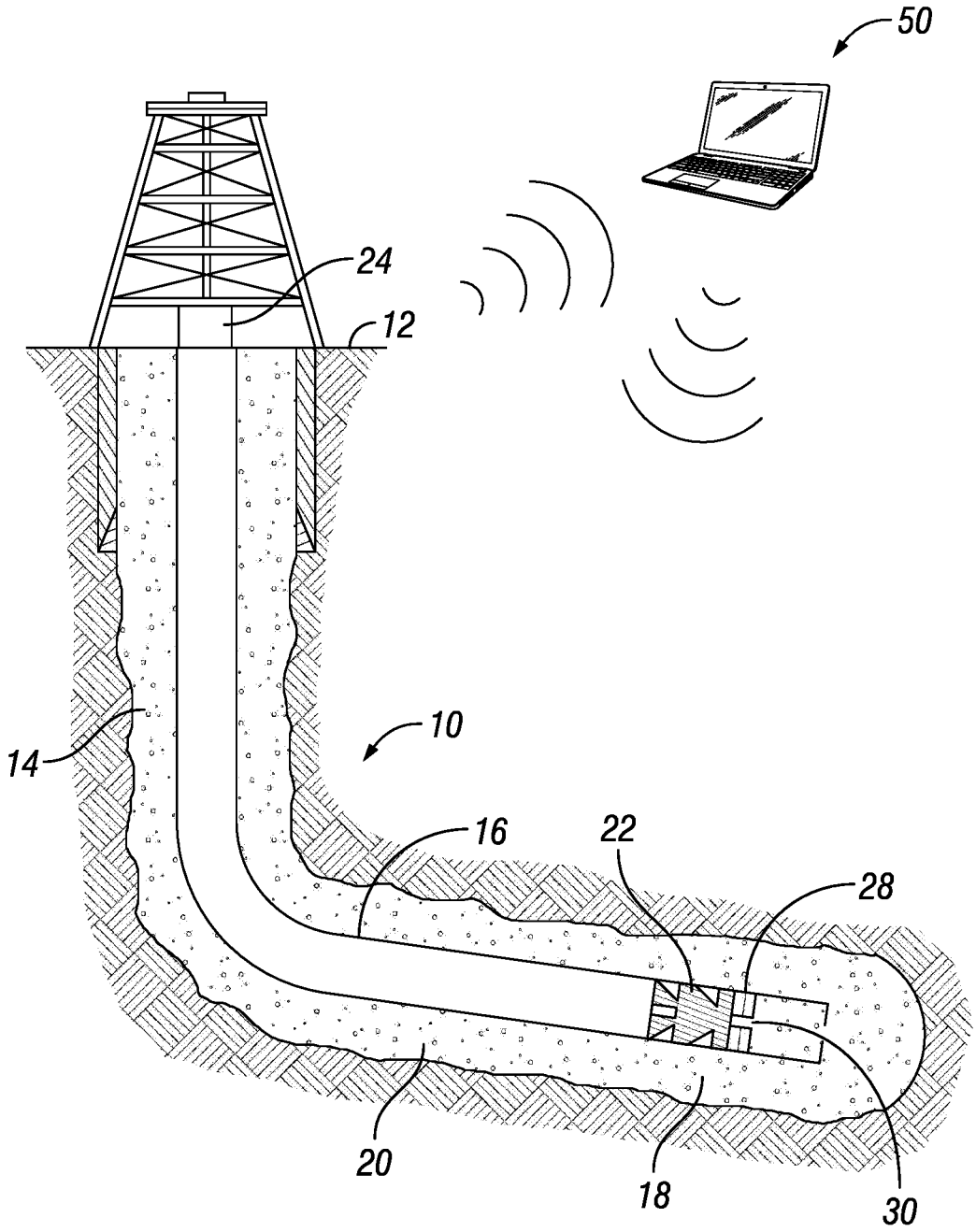
FIG. 2 is a partial section view of a subterranean well with a smart cementing wiper plug, in accordance with an embodiment of this disclosure, shown with the smart cementing wiper plug landed on a landing collar.

Looking at FIG. 2, wiper plug assembly 22 can travel through the bore of casing string 16 and land on landing collar 28. Landing collar 28 is a generally disk shaped member that is secured within the bore of casing string 16. Landing collar 28 has opening 30 that extends axially through landing collar 28 from an uphole side of landing collar 28 to a downhole side of landing collar 28. Opening 30 can include a valve that can be moved between an open and closed position for controlling the flow of fluid through landing collar 28.

With wiper plug assembly 22 landed on landing collar 28, wiper plug assembly can prevent the flow of fluid through landing collar 28. When wiper plug assembly 22 lands on landing collar 28 there can therefore be a noticeable buildup of pressure within the bore of casing string 16 that can be an indication to an operator that wiper plug assembly 22 has landed on landing collar 28.

Figure 3:
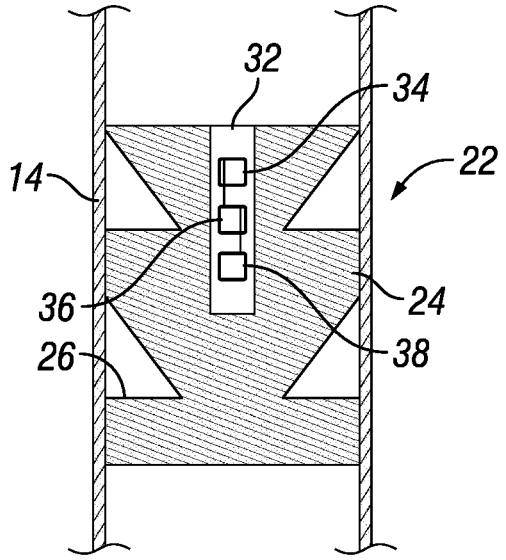
FIG. 3 is a schematic section view of a smart cementing wiper plug, in accordance with an embodiment of this disclosure.

Looking at FIG. 3, wiper plug assembly 22 can include wiper plug body 24. Wiper plug body 24 can be formed of aluminum or other suitable resilient material known in the industry for forming wiper plugs. Wiper plug body 24 can have a generally circular cross section. Wiper plug body 24 has one or more resilient wiper elements 26 that are sized to engage an inner diameter of casing string 16. Resilient wiper elements 26 extend radially outward to contact the inner diameter of casing string 16. Certain of the resilient wiper elements 26 can be formed, for example, of a rubber material. Resilient wiper elements 26 can wipe any excess or remaining cement from the inner diameter surface of casing string 16 and can centralize wiper plug assembly 22 within casing string 16. Certain of the resilient wiper elements 26 can be releasably secured, such as by threads, so that such resilient wiper elements 26 can be removed and replaced if worn or damaged, or when a different size of resilient wiper element 26 is required for a different sized casing string 16.

Figure 4:
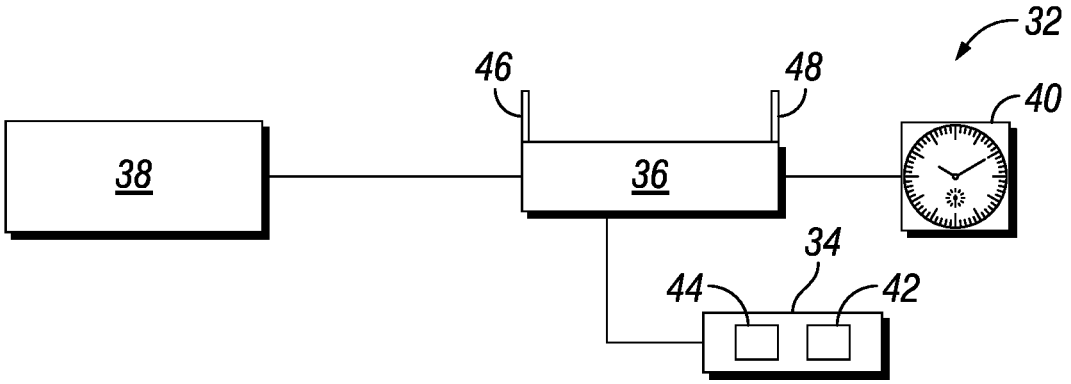
FIG. 4 is a schematic diagram of an electronics package of a smart cementing wiper plug, in accordance with an embodiment of this disclosure.

Looking at FIGS. 3-4, wiper plug assembly 22 can further include electronics package 32. Electronics package 32 can be located within wiper plug body 24. Electronics package 32 can include an instruments module 34 and a control unit 36. In alternate embodiments, electronics package 32 can further include battery 38 and timer 40.

Instruments module 34 can include accelerometer assembly 42. Accelerometer assembly 42 can measure an inclination of wiper plug assembly 22 in three dimensions in real time. The measurement of the inclination of wiper plug assembly 22 can be taken when wiper plug assembly 22 is static or as wiper plug assembly moves through casing string 16. The measurement of the inclination can be performed continuously, at predetermined intervals, or on demand when determined by an operator.

Instruments module 34 can further include magnetometer 44. Magnetometer 44 can measure an azimuth of wiper plug assembly 22 in three dimensions in real time. The measurement of the azimuth of wiper plug assembly 22 can be taken when wiper plug assembly 22 is static or as wiper plug assembly moves through casing string 16. The measurement of the azimuth can be performed continuously, at predetermined intervals, or on demand when determined by an operator.

The measured inclination and azimuth of wiper plug assembly 22 can be delivered to control unit 36 in real time. Control unit 36 can receive and process the inclination and the azimuth of wiper plug assembly 22.

Control unit 36 can include transmitter 46 and receiver 48. Transmitter 46 can be used to deliver the inclination of wiper plug assembly 22 to an earth's surface 12 in real time. Computational device 50 (FIG. 1) can receive the inclination of wiper plug assembly 22 at earth's surface 12. Computational device 50 can be, for example, a personal computer, a tablet device, a mobile phone, or other device that can receive data.

Transmitter 46 can deliver data to computational device 50 wirelessly, such as by radio waves. In alternate embodiments, transmitter 46 and receiver 48 can be in communication with the earth's surface through a wireless closed loop communication system, such as a system that uses radio waves. Receiver 48 can, as an example, receive an instruction to turn features of wiper plug assembly 22 on or off. Transmitter 46 can further provide diagnostic information relating to components of wiper plug assembly 22 to receiver 48, such as diagnostic information relating to sensors and electronics of wiper plug assembly 22.

Computational device 50 can use the inclination of wiper plug assembly 22, the azimuth of wiper plug assembly 22, or both the inclination and azimuth of wiper plug assembly 22 to determine the position of wiper plug assembly 22 within casing string 16 of subterranean well 10 in real time. In embodiments, computational device 50 can utilize a known survey of subterranean well 10 and compare the inclination and azimuth of wiper plug assembly 22 to the known survey of subterranean well 10 to determine the location of wiper plug assembly 22 within casing string 16. By comparing the inclination and azimuth of wiper plug assembly 22 to the known survey of subterranean well 10, the accuracy of the known survey of subterranean well 10 can be further validated.

In embodiments, because the inclination and azimuth of wiper plug assembly 22 is being provided to computational device 50 in real time and computational device 50 is using the inclination and azimuth to determine the location of wiper plug assembly 22 within wellbore 10 in real time, the travel of wiper plug assembly 22 through casing string 16 of subterranean well 10 can be tracked on computational device 50 in real time.

The inclination and azimuth of wiper plug assembly 22 together with computational device 50 can be used to confirm successful operation of wiper plug assembly 22 throughout the expected use of wiper plug assembly 22. As an example, the inclination and azimuth of wiper plug assembly 22 together with computational device 50 can be used in real time to confirm that wiper plug assembly 22 has been successfully launched and exited cement head 24. The inclination and azimuth of wiper plug assembly 22 together with computational device 50 can further be used in real time to confirm that wiper plug assembly 22 has landed on landing collar 28 within subterranean well 10.

The inclination and azimuth of wiper plug assembly 22 together with computational device 50 can still further be used in real time to confirm that wiper plug assembly 22 has not become stuck within casing string 16 and is progressing through casing string 16 in an expected timeframe. If wiper plug assembly 22 was to become stuck within casing string 16 an operator might assume that wiper plug assembly 22 has landed on landing collar 28 in error. Systems and methods of this disclosure can be used to confirm the location of wiper plug assembly 22 within casing string 16 so that such errors are avoided.

If wiper plug assembly 22 has become stuck or is not progressing through casing string 16 as expected, an operator can increase the pressure within casing string 16 uphole of wiper plug assembly. Computational device 50 can be monitored to determine how such increase in pressure affects the travel of wiper plug assembly 22 through casing string 16 in real time. An operator can continue to track the progress of wiper plug assembly 22 through casing string 16 in real time, making further adjustments to the pressure within casing string 16 uphole of wiper plug assembly 22 to optimize the travel of wiper plug assembly 22 for providing the most effective cementing operation.

Looking at FIGS. 3-4, in certain embodiments, timer 40 can be used to determine the start of the measuring of the inclination of wiper plug assembly 22 and the measuring of the azimuth of the wiper plug assembly 22. Timer 40 can be pre-set before wiper plug assembly 22 is loaded into cement head 24. Timer 40 can be used to both start and stop the measuring of the inclination of wiper plug assembly 22 and the measuring of the azimuth of the wiper plug assembly 22. By delaying the measuring of the inclination of wiper plug assembly 22 and the measuring of the azimuth of the wiper plug assembly 22 until a certain time after wiper plug assembly 22 is loaded into cement head 24, the life of battery 38 can be extended.

Battery 38 can be a power source for and in communication with control unit 36. Battery 38 can be any type of battery that can provide sufficient power to control unit 36 for the duration of the cementing operation.

In an example of operation, a method for completing cementing operations in subterranean well 10 with wiper plug assembly 22 includes loading wiper plug assembly 22 into cement head 24. Cement head 24 is in communication with a bore of casing string 16. Wiper plug assembly 22 can be launched into casing string 16 from cement head 24.

The inclination of wiper plug assembly 22 can be measured in three dimensions with accelerometer assembly 42. The azimuth of wiper plug assembly 22 can be measured in three dimensions with magnetometer 44. The inclination of wiper plug assembly 22 can be determined in real time. The inclination of wiper plug assembly 22 can be delivered to computational device 50 at an earth's surface 12 in real time with transmitter 46 of electronics package 32. The location of wiper plug assembly 22 within subterranean well 10 can be determined with computational device 50 in real time from the inclination and azimuth of wiper plug assembly 22.

Embodiments described in this disclosure therefore provide systems and methods for tracking a wiper plug in real time to ensure a successful cementing operation of a wellbore casing. The wiper plug assembly can communicate with the earth's surface and deliver the inclination, azimuth, and diagnostic information relating to the wiper plug assembly. An operator can confirm that the wiper plug assembly in successfully launched from the cement head and successfully lands in a landing collar.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for completing cementing operations in a subterranean well with a wiper plug assembly, the method including:

delivering the wiper plug assembly into a casing string that extends into the subterranean well, the wiper plug assembly having a wiper plug body with a circular cross section and a resilient wiper element that engages an inner diameter of the casing string;

measuring an inclination of the wiper plug assembly in three dimensions with an accelerometer assembly of an electronics package of the wiper plug assembly that is located within the wiper plug body;

measuring an azimuth of the wiper plug assembly in three dimensions with a magnetometer of the electronics package;

delivering the inclination and the azimuth of the wiper plug assembly to a control unit of the electronics package in real time;

delivering the inclination of the wiper plug assembly to an earth's surface in real time with a transmitter of the electronics package; and using the inclination of the wiper plug assembly to confirm that the wiper plug assembly has exited a cement head with a computational device at the earth's surface.

2. The method of claim 1, further including using the inclination of the wiper plug assembly to determine a location of the wiper plug assembly within the subterranean well with a computational device at the earth's surface.

3. The method of claim 2, where determining the location of the wiper plug assembly within the subterranean well further includes comparing the inclination of the wiper plug assembly to a known survey of the subterranean well.

4. The method of claim 2, further including tracking a travel of the wiper plug assembly through the subterranean well in real time at the earth's surface on the computational device.

5. The method of claim 1, further including using the inclination of the wiper plug assembly to confirm that the wiper plug assembly has landed on a landing collar within the subterranean well with a computational device at the earth's surface.

6. The method of claim 1, where the wiper plug assembly includes a timer and the method further includes using the timer to determine a start of the measuring of the inclination of the wiper plug assembly and a start of the measuring of the azimuth of the wiper plug assembly.

7. A method for completing cementing operations in a subterranean well with a wiper plug assembly, the method including:

loading the wiper plug assembly into a cement head in communication with a bore of a casing string that extends into the subterranean well;

launching the wiper plug assembly into the casing string from the cement head;

measuring an inclination of the wiper plug assembly in three dimensions with an accelerometer assembly of an electronics package of the wiper plug assembly;

measuring an azimuth of the wiper plug assembly in three dimensions with a magnetometer of the electronics package;

delivering the inclination and the azimuth of the wiper plug assembly to a control unit of the electronics package in real time;

delivering the inclination and the azimuth of the wiper plug assembly to a computational device at an earth's surface in real time with a transmitter of the electronics package; and determining a location of the wiper plug assembly within the subterranean well with the computational device at the earth's surface in real time from the inclination and the azimuth of the wiper plug assembly.

8. The method of claim 7, where determining the location of the wiper plug assembly within the subterranean well further includes comparing the inclination of the wiper plug assembly to a known survey of the subterranean well.

9. The method of claim 7, further including tracking a travel of the wiper plug assembly through the subterranean well in real time at the earth's surface on the computational device.

10. The method of claim 7, further including using the inclination of the wiper plug assembly to confirm that the wiper plug assembly has exited the cement head with the computational device at the earth's surface in real time.

11. The method of claim 7, further including using the inclination of the wiper plug assembly to confirm that the wiper plug assembly has landed on a landing collar within the subterranean well with the computational device at the earth's surface in real time.

12. The method of claim 7, where the wiper plug assembly includes a timer and the method further includes using the timer to determine a start of the measuring of the inclination of the wiper plug assembly and a start of the measuring of the azimuth of the wiper plug assembly.

13. A method for completing cementing operations in a subterranean well with a wiper plug assembly, the method including:

delivering the wiper plug assembly into a casing string that extends into the subterranean well, the wiper plug assembly having a wiper plug body with a circular cross section and a resilient wiper element that engages an inner diameter of the casing string;

measuring an inclination of the wiper plug assembly in three dimensions with an accelerometer assembly of an electronics package of the wiper plug assembly that is located within the wiper plug body;

measuring an azimuth of the wiper plug assembly in three dimensions with a magnetometer of the electronics package;

delivering the inclination and the azimuth of the wiper plug assembly to a control unit of the electronics package in real time;

delivering the inclination of the wiper plug assembly to an earth's surface in real time with a transmitter of the electronics package; and using the inclination of the wiper plug assembly to confirm that the wiper plug assembly has landed on a landing collar within the subterranean well with a computational device at the earth's surface.

* * * * *